US009893498B2

(12) United States Patent
Yamada

(10) Patent No.: US 9,893,498 B2
(45) Date of Patent: Feb. 13, 2018

(54) METHOD FOR MANUFACTURING TUBULAR METAL SHELL INCLUDING GROUND ELECTRODE BAR FOR SPARK PLUG, AND METHOD FOR MANUFACTURING SPARK PLUG

(71) Applicant: NGK Spark Plug Co., LTD., Nagoya (JP)

(72) Inventor: Takumi Yamada, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/584,185

(22) Filed: May 2, 2017

(65) Prior Publication Data

US 2017/0333977 A1 Nov. 23, 2017

(30) Foreign Application Priority Data

May 18, 2016 (JP) ..... 2016-099530

(51) Int. Cl.

| | |
|---|---|
| ***H01T 13/20*** | (2006.01) |
| ***H01T 13/58*** | (2011.01) |
| ***H01T 13/08*** | (2006.01) |
| ***H01T 21/02*** | (2006.01) |

(52) U.S. Cl.

CPC ..... *H01T 21/02* (2013.01); *H01T 13/20* (2013.01)

(58) Field of Classification Search

CPC ..... H01T 21/02; H01T 13/39; H01T 13/38; H01T 13/20; H01T 13/34; H01T 13/36; H01T 13/467; H01T 13/52

See application file for complete search history.

(56) References Cited

U.S. PATENT DOCUMENTS

2006/0202599 A1* 9/2006 Kato ..... H01T 13/14 313/143

2007/0222351 A1* 9/2007 Nunome ..... B28B 1/30 313/143

FOREIGN PATENT DOCUMENTS

JP 2014-135213 A 7/2014

* cited by examiner

*Primary Examiner* — Tracie Y Green

(74) *Attorney, Agent, or Firm* — Leason Ellis LLP

(57) ABSTRACT

A pair of electrode lugs clamp a bar at side surfaces of the bar so as to be electrically connected to the bar. The electrode lugs respectively include a first contact portion and a second contact portion having different front-back lengths. The bar is clamped such that the first contact portion having a short front-back length L1 opposes a back end portion of the bar within a range of the second contact portion having a front-back length L2. The back end surface of the bar is brought into contact with and welded to a front end surface of a metal shell by resistance butt welding. Since the first contact portion of one lug is short and is close to the abutting surfaces, heat dissipation can be reduced and heat concentration can be increased.

5 Claims, 7 Drawing Sheets

METHOD FOR MANUFACTURING TUBULAR METAL SHELL INCLUDING GROUND ELECTRODE BAR FOR SPARK PLUG, AND METHOD FOR MANUFACTURING SPARK PLUG

This application claims the benefit of Japanese Patent Application No. 2016-099530, filed May 18, 2016, which is incorporated herein in its entirety by reference.

FIELD OF THE INVENTION

The present invention relates to a method for manufacturing a tubular metal shell including a ground electrode bar for a spark plug by bringing a front end surface of a tubular metal shell for a spark plug and a back end surface of a bar, which is a ground electrode member, into contact with each other, and passing an electric current between resistance welding electrodes that are electrically connected to the tubular metal shell and the bar, thereby welding the tubular metal shell and the bar together by resistance butt welding. The present invention also relates to a method for manufacturing a spark plug.

BACKGROUND OF THE INVENTION

FIG. 8 is a longitudinal half-sectional view of a spark plug 1. The spark plug 1 includes a tubular metal shell (hereinafter also referred to simply as a metal shell) 10 including portions of different diameters; an insulator 30 having a hollow cylindrical shape that extends through the metal shell 10; and a center electrode 50 that is disposed in a central axial hole in the insulator 30 and that has a tip exposed at a front end (top end in FIG. 8) of the insulator 30. The metal shell 10 includes a ground electrode 20*b*, which is a bar that is fixed to a front end surface 13 of the metal shell 10 and that is bent inward (toward a central axis O). A spark discharge gap G is formed between the tip of the ground electrode 20*b* and the tip of the center electrode 50. As illustrated in FIG. 9, the metal shell 10 is manufactured by arranging a bar that serves as a ground electrode member (hereinafter also referred to simply as a bar) 20 so that one end (back end surface) 25 of the bar 20 perpendicularly faces the front end surface 13 the metal shell 10 that serves as a part (single item), and resistance-welding the bar 20 to the metal shell 10. Then, as illustrated in FIG. 10A, the metal shell 10 is subjected to, for example, a process of forming a thread 16 on an outer peripheral surface 15 thereof, and is transferred to a spark plug assembly process. In the spark plug assembly process, the above-described insulator 30 and other components are attached to the metal shell 10 including the bar (see FIGS. 10A and B), and a back end 17 of the metal shell 10 is bent inward and compressed (crimped) toward the front (see FIGS. 10B and 10C). After the assembly, as illustrated in FIG. 10C, the bar 20 is bent inward and serves as the ground electrode 20*b* that defines a predetermined spark discharge gap.

The bar 20 has conventionally been welded to the front end surface 13 of the metal shell 10 by resistance butt welding as follows. First, as illustrated in FIG. 9, the metal shell (work in process) 10 is secured by being clamped, for example, by one resistance welding electrode (electrode made of copper or a copper alloy, which is not illustrated) of a resistance welding machine (not illustrated). The bar 20 is held by the other resistance welding electrode 210, 220. Then, the back end surface 25 (bottom face in FIG. 9) of the bar 20 is arranged so as to perpendicularly face the front end surface 13 of the metal shell 10 at a predetermined position, and is brought into contact with the front end surface 13. In the contact state, a large electric current is passed between the resistance welding electrodes (the electrode that holds the metal shell 10 and the electrode that holds the bar 20), so that the abutting surfaces of the two members (the front end surface 13 of the metal shell 10 and the back end surface 25 of the bar 20) that are in contact with each other are melted by resistance heating, and are pressed and welded together (see, for example, FIG. 6 of Japanese Unexamined Patent Application Publication No. 2014-135213). In the welding process, the bar 20, which is a ground electrode member, has conventionally been held by clamp-type holding means illustrated in FIG. 9. The holding means includes a pair of electrode lugs 210 and 220 that camp the bar 20 at opposite side surfaces thereof so as to be electrically connected to the bar 20.

The spark plug manufactured by the above-described resistance butt welding process (hereinafter also referred to simply as a welding process) is required to have high dimensional precision and welding (joining) strength to ensure sufficient performance thereof. The bar 20, which is a ground electrode member, may be a thin round bar (columnar member), but is typically a small strip-shaped bar (rectangular bar) that is about 2 to 3 mm wide and about 1 to 1.5 mm thick in cross section and that is about 20 mm long. To precisely and strongly weld such a small bar, it is necessary to precisely control not only the welding conditions, such as the current and welding time, but also the vertical orientation in which the bar 20 is held and the orientation in which the bar 20 is positioned relative to the front end surface 13 of the metal shell 10. In consideration of the above-described requirements and the use of a large amount of current in the welding process, the electrode lugs 210 and 220, which serve as a resistance welding electrode used to hold the bar 20, include clamping portions, that is, contact portions, that are capable of clamping the bar (rectangular bar) 20 at the side surfaces thereof over substantially the entire length in the front-back direction. The contact portions of the electrode lugs, which oppose each other and come into contact with the bar to clamp the bar, have the same front-back length so that the bar can be clamped at the side surfaces thereof in a balanced manner.

Unfortunately, the welding process in which the bar is clamped by the above-described electrode lugs has the following problems. That is, heat is dissipated into the electrode lugs 210 and 220 during resistance heating, and heat concentration and heating efficiency at the abutting surfaces are reduced due to the heat dissipation. This will be described in more detail below. Since the bar 20 is small and short in the front-back direction as described above, electrode lugs that are capable of clamping the bar 20 over substantially the entire length thereof in the front-back direction are used as the electrode lugs 210 and 220 of the resistance welding electrode. Therefore, the electrode lugs are in contact with the bar over a large contact area (contact area between the contact portions and the bar). The electrode (electrode lugs) that holds the bar is typically made of copper (or a copper alloy), which is highly conductive. In addition, since the bar is small, the volume of the electrode lugs is comparatively large. When the bar is subjected to resistance heating by passing a resistance welding current while the bar is clamped by the electrode lugs that are in contact with the bar over a large area, a large portion of the generated heat is transmitted or dissipated into the electrode lugs that clamp the bar, that is, into an electrode of the resistance welding machine. Thus, in the above-described welding process according to the related art, a large amount of heat dissipation occurs during resistance heating. Therefore, the temperature increase at the abutting surfaces to be welded together (the back end surface of the bar 20 and the front end surface 13 of the metal shell 10) is suppressed, and the heating efficiency (heat concentration) is reduced. As a result, in the above-described welding process, the abutting surfaces cannot be efficiently melted and welded together. This is said to lead to a low and insufficient welding strength.

The metal shell of the spark plug is made of a ferrous material, such as low-carbon steel. The bar, which is the ground electrode member, is made of a Ni alloy. Thus, members made of different metals are welded together. Therefore, the welding conditions (current, welding time, and pressing force) need to be set within narrow allowable ranges, and it is difficult to obtain sufficient joining strength. In particular, in the case where the bar has a composite structure including a core made of copper and a peripheral wall made of a Ni alloy in cross section, the welding surface contains the Ni alloy. In such a case, the weldability is low, and the joining strength is easily reduced when the joining surface (cross section) that serves as the welding surface (abutting end surface) is small. Therefore, when the bar having a composite structure is welded, resistance heating needs to be performed efficiently and effectively with small heat dissipation from the viewpoint of preventing breakage of the bar in the subsequent bending step. To reduce heat dissipation to the pair of electrode lugs (electrode), the contact area between the contact portions and the bar may be reduced by reducing the size of the contact portions. However, in such a case, there is a possibility that the bar will be held in an unstable orientation and tilted due to, for example, wear of the electrode lugs. As a result, it becomes difficult to maintain high precision.

SUMMARY OF THE INVENTION

The present invention has been made in light of the above-described problems, and an object of the present invention is to increase welding efficiency and achieve sufficient welding strength, etc., at a welding position in resistance butt welding for welding a bar, which is a ground electrode member, to a front end surface of a tubular metal shell. This is achieved by reducing dissipation of heat, which is generated by resistance heating at the abutting surfaces when a welding current is applied, to electrode lugs that serve as a resistance welding electrode, thereby increasing heat concentration and heating efficiency at the abutting surfaces, without reducing the precision of, for example, the orientation of the bar.

According to a first aspect of the present invention, a method for manufacturing a tubular metal shell of a spark plug including bar used for a ground electrode member of the spark plug, the method comprising the steps of bringing a front end surface of the tubular metal shell and a back end surface of the bar into contact with each other; and passing an electric current between resistance welding electrodes that are electrically connected to the tubular metal shell and the bar. One of the resistance welding electrodes is a pair of electrode lugs that are electrically connected to the bar and have a clamping structure in which the bar is clamped at side surfaces of the bar to be electrically connected. One of the electrode lugs includes a first contact portion that comes into contact with the bar and the other of the electrode lugs includes a second contact portion that comes into contact with the bar, the first contact portion having a front-back length shorter than a front-back length of the second contact portion, and coming into contact with the bar over a contact area smaller than a contact area over which the second contact portion comes into contact with the bar. When the bar is clamped between the electrode lugs, the second contact portion is in surface-to-surface contact with the corresponding side surface of the bar.

According to a second aspect of the present invention, in the method according to the first aspect of the present invention, the bar is clamped between the first contact portion and a portion of the second contact portion at or near a back end of the second contact portion.

According to a third aspect of the present invention, in the method according to the first aspect of the present invention, the first contact portion includes a flat surface.

According to a fourth aspect of the present invention, in the method according to any one of the first to third aspects, at least one of the first contact portion or the second contact portion has a recessed groove capable of receiving the bar.

According to a fifth aspect of the present invention, a method for manufacturing a spark plug includes the step of manufacturing the tubular metal shell by the method according to any one of the first to fourth aspects.

According to the first aspect of the present invention, one of the electrode lugs includes the first contact portion that comes into contact with the bar and the other of the electrode lugs includes the second contact portion that comes into contact with the bar. The first contact portion has a front-back length shorter than a front-back length of the second contact portion, and comes into contact with the bar over a contact area smaller than a contact area over which the second contact portion comes into contact with the bar. When the bar is clamped between the electrode lugs, the second contact portion is in surface-to-surface contact with the corresponding side surface of the bar. According to the related art, the bar is clamped by a pair of electrode lugs including contact portions that come into contact with the bar, and the contact portions of both electrode lugs are long in the front-back length. In contrast, according to the present invention, the front-back length of the first contact portion, which is the contact portion of one electrode lug, is shorter than that of the second contact portion, which is the contact portion of the other electrode lug, so that the contact area between the resistance welding electrode and the bar is reduced. Accordingly, during resistance welding in which heat is generated between the abutting surfaces of the metal shell and the bar due to resistance heating, dissipation of the generated heat toward the electrode lugs (resistance welding electrode) that clamp the bar can be reduced. As a result, heat concentration and heating efficiency at the abutting surfaces that are welded together can be increased from those in the related art, and therefore the welding efficiency, welding performance such as welding strength, and reliability of the welded portion are increased. From the viewpoint of preventing heat conduction (heat dissipation) to the electrode lugs, the contact area between the first contact portion and the bar is preferably made as small as possible to reduce the contact area (heat conduction area).

In addition, according to the present invention, although the contact area between the first contact portion and the bar is smaller than that between the second contact portion and the bar, the bar is prevented from being clamped in an unstable manner owing to the above-described structure. The contact area between the first contact portion and the bar can be reduced by reducing the front-back length of the first contact portion. When the contact portions of both electrode lugs are short, the clamped bar is easily tilted in the clamping direction (direction perpendicular to the clamping surfaces)

and is easily held in an unstable orientation due to, for example, wear of the contact portions. However, according to the present invention, since only one of the contact portions is reduced in length, the bar can be prevented from being clamped in an unstable orientation. As a result, heat dissipation can be reduced without reducing the stability of the orientation of the bar.

As in the second aspect of the present invention, the bar is preferably clamped between the first contact portion and a portion of the second contact portion at or near a back end of the second contact portion. In this case, the electrode lug including the first contact portion having a shorter front-back length than the second contact portion can be brought into contact with the bar at a location close to the back end surface of the bar, that is, close to the abutting surfaces to be welded together. Therefore, the abutting surfaces, at which heat generation is to be concentrated, can be effectively and efficiently heated. The material of the bar is not limited to a Ni alloy, and the bar may have a composite structure including a core made of copper and a peripheral wall made of a Ni alloy in cross section. In this case, the bar is difficult to weld because the bar contains copper, and the weldability thereof is low. However, according to the present invention, the weldability of the bar can be increased because heat concentration can be increased.

Also in the second aspect, the front-back length of the first contact portion, which is shorter than the front-back length of the second contact portion, is preferably as short as possible to reduce heat dissipation (heat conduction) to the electrode lugs and increase heat concentration. As in the third aspect of the present invention, the first contact portion preferably includes a flat surface. The reason for this is as follows. The front-back length of the first contact portion is preferably reduced to reduce the contact area between the first contact portion and the bar in the clamped state and to reduce heat conduction. As the front-back length decreases, the first contact portion that clamps the bar becomes sharper, and the contact surface of the bar that comes into contact with the first contact portion receives a larger clamping pressure (force per unit area) in a local region. Furthermore, owing to stress concentration, the local region (surface) is easily dented or damaged, and a large stress is easily generated in the local region. The thermal influence of heat concentration at the local region in the welding process may lead to partial embrittlement around the local region and reduction in strength. The reduction in strength leads to, for example, breakage of the bar in the subsequent bending process for forming the spark discharge gap. These risks can be reduced when the first contact portion having a front-back length shorter than that of the second contact portion includes a flat surface as in the third aspect of the present invention. The first contact portion may have a curved surface (or a spherical surface) having a large radius instead of the flat surface.

As in the fourth aspect of the present invention, at least one of the first contact portion and the second contact portion may have a recessed groove capable of receiving the bar. In such a case, the clamped bar can be prevented from moving horizontally (in the direction along the clamping surfaces) or being tilted. As a result, the bar can be clamped in a more stable position and orientation. According to the fifth aspect of the present invention, a high-quality spark plug to which a ground electrode is strongly joined can be obtained.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Figure 1:
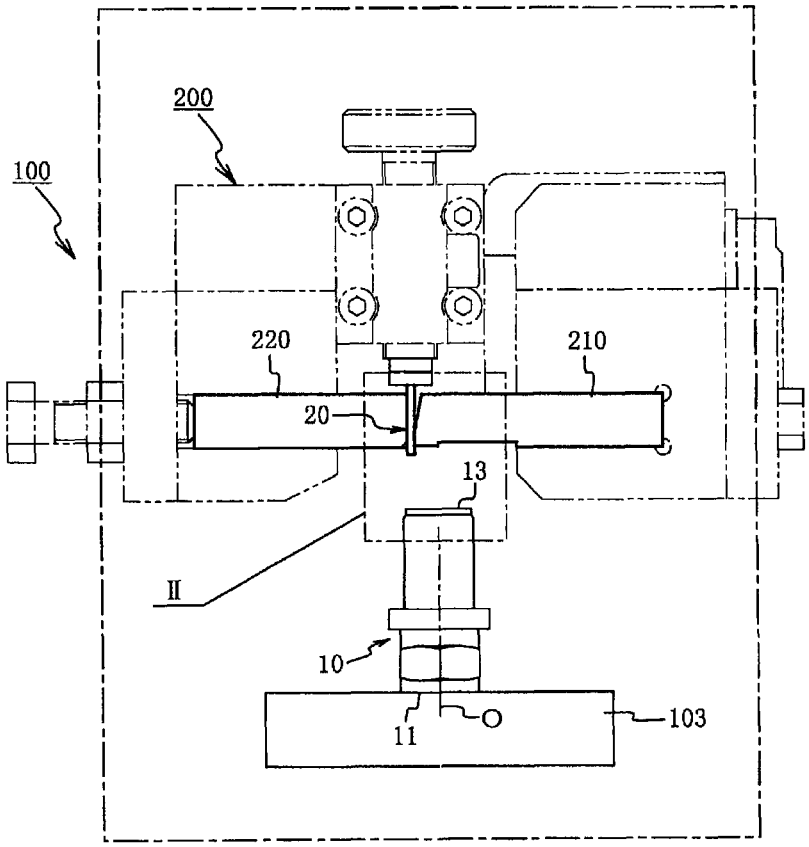
FIG. 1 is a schematic front view illustrating the state before a bar clamped by a pair of electrode lugs for resistance welding is brought into contact with a front end surface of a metal shell according to an embodiment of the present invention.
Figure 9:
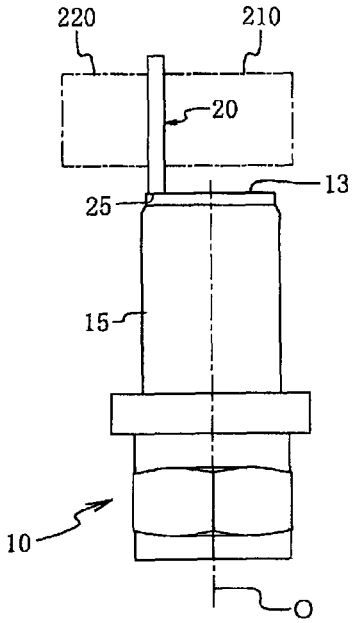
FIG. 9 is a schematic diagram illustrating the state in which a bar is held by a resistance welding electrode when the bar is resistance-welded to a front end surface of a metal shell (work in process) in a known method for manufacturing a tubular metal shell including a ground electrode bar for the spark plug illustrated in FIG. 8 according.
Figure 10A:
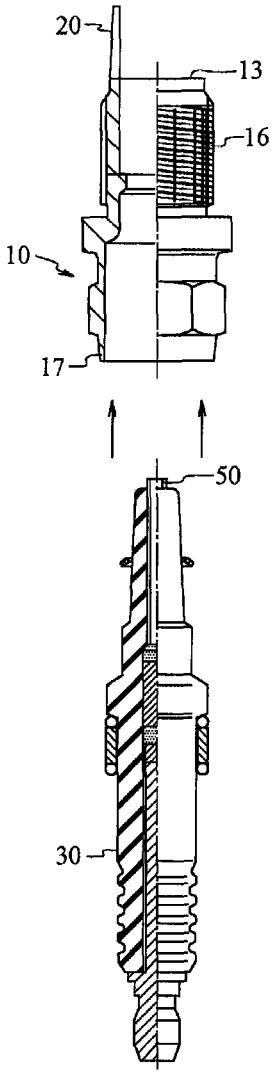
FIGS. 10A to 10C illustrate a step of assembling the spark plug illustrated in FIG. 8.
Figure 10B:
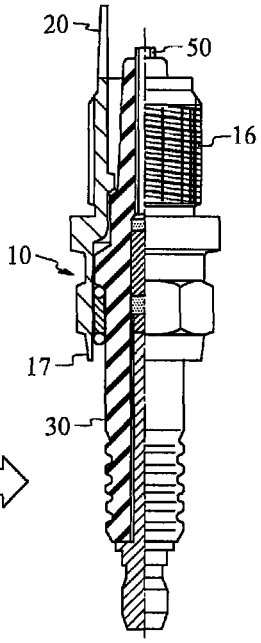
Figure 10C:
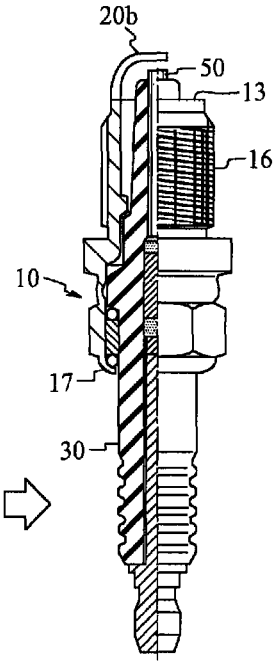

A method for manufacturing a tubular metal shell including a ground electrode bar for a spark plug according to an embodiment of the present invention (example of a welding method) will be described in detail below with reference to FIGS. 1 to 5. In the present embodiment, a metal shell 10 that is the same as that illustrated in FIG. 9 (work in process to which the bar is not yet welded) is prepared, and a ground electrode bar 20 is brought into contact with and resistance-welded to a front end surface 13 (top surface in FIG. 9) of the metal shell 10. Although the bar 20 may be a round bar (columnar member) or a polygonal bar having a cross section that is not rectangular, it is assumed that the bar 20 is a rectangular bar in this example. As illustrated in FIG. 1, a bottom end 11 of the tubular metal shell 10 is placed on a base 103 of a resistance butt welding machine 100 and is clamped, for example, by one resistance welding electrode (not shown) so that the metal shell 10 is positioned and secured. The bar 20 is clamped by a pair of electrode lugs 210 and 220, which serve as the other resistance welding electrode, at opposite side surfaces 22 and 23 thereof, and is thereby electrically connected to the electrode lugs 210 and 220. The lugs 210 and 220 are mounted in an electrode lug device 200 including a chuck mechanism that slides the lugs 210 and 220 relative to each other so that opposing end surfaces (clamping surfaces) of the lugs 210 and 220 move toward and away from each other. The lugs 210 and 220 are closed and clamp the bar 20 when driven by lug opening/ closing means (not shown). A back end surface 25 of the bar 20 is brought into contact with the front end surface 13 of the metal shell 10.

Figure 2:
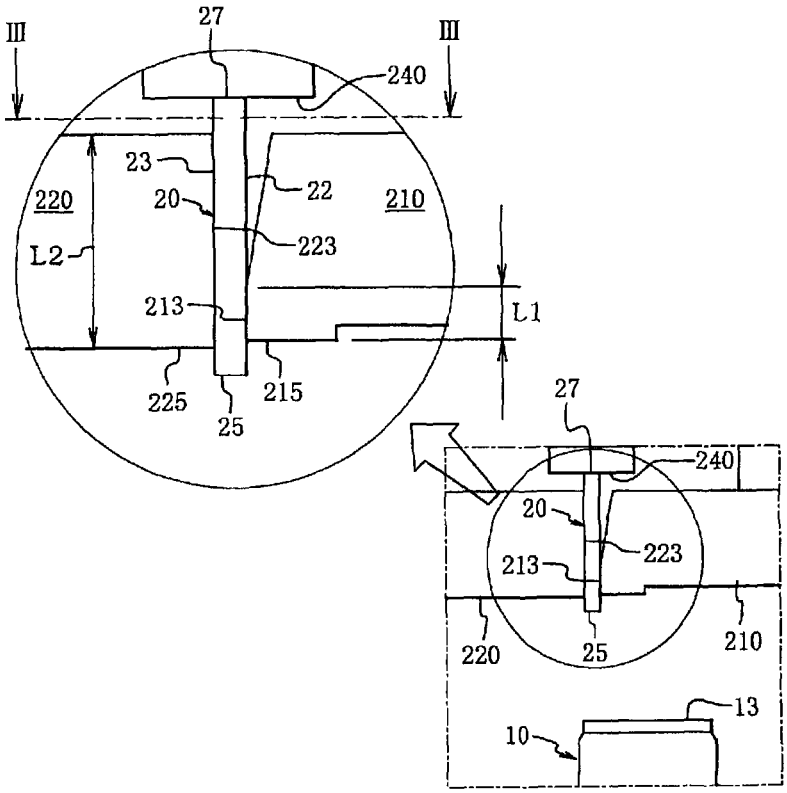
FIG. 2 shows an enlarged view of part II in FIG. 1, and a further enlarged view of a portion of part II.
Figure 3:
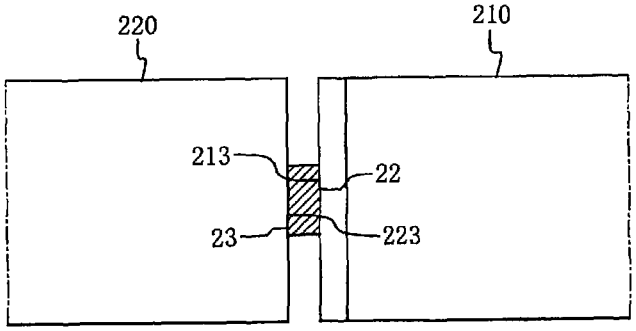
FIG. 3 is a sectional view taken along line III-III in FIG. 2.

In this example, the electrode lugs 210 and 220 are substantially horizontally oriented rectangular blocks that oppose each other in the electrode lug device 200. The left and right end surfaces of the electrode lugs 210 and 220 that oppose each other in the drawings are defined as a first contact portion 213 and a second contact portion 223, respectively. The bar 20 can be clamped between the first and second contact portions 213 and 223 by sliding one of the lugs. In this example, the pair of electrode lugs (horizontally oriented rectangular blocks) 210 and 220 may seem to have the same size and shape. However, in practice, the first and second contact portions 213 and 223 that clamp the bar 20 have front-back lengths (lengths in the vertical direction in FIGS. 1 and 2) that differ by a large amount, and the ratio between the front-back lengths thereof is, for example, about 3 to 1. In this example, the first contact portion 213 of the right electrode lug 210 in the drawings has a short front-back length L1, and the second contact portion 223 of the left electrode lug 220 in the drawings has a long front-back length L2 (see FIG. 2). The front-back length L2 of the second contact portion (end surface) 223 of the left electrode lug 220 that contacts the bar 20 corresponds to the length of substantially the entirety of the bar 20 excluding front and back end portions (top and bottom end portions in FIG. 1) thereof, and is substantially equal to the length L2 of the vertical sides of the end surface of the horizontally oriented rectangular block in the drawings. The second contact portion (end surface) 223 has a width that is greater than the width of the bar 20 (width in cross section), as illustrated in FIG. 3, and includes a vertical surface (vertical surface extending in the front-back direction).

The right electrode lug 210 includes the first contact portion 213 that contacts the bar 20. The first contact portion 213 is a bottom portion whose length L1 is about ⅓ of the overall length in the front-back direction (vertical direction in FIG. 1), and includes a vertical surface. A top portion (front portion) that is above the vertical surface in FIGS. 1 and 2 and whose length is about ⅔ of the overall length in the vertical direction is obliquely cut. Thus, the distance between the right electrode lug 210 and the second contact portion (end surface) 223 of the electrode lug 220 that opposes the electrode lug 210 increases toward the top, as illustrated in FIGS. 1 and 2. Thus, in this example, the right electrode lug 210 in FIG. 1 includes the first contact portion 213 that is short in the front-back direction, and the left electrode lug 220 in FIG. 1 includes the second contact portion 223 that is long in the front-back direction. The right electrode lug 210 and the left electrode lug 220 oppose each other so that the range of the first contact portion 213 having the front-back length L1 is within the range of the second contact portion 223 having the front-back length L2 in the front-back direction. Thus, in this example, the first contact portion 213 opposes the second contact portion 223 of the electrode lug 220 having the front-back length L2 over the entire length thereof in the front-back direction. However, as long as the bar 20 can be appropriately clamped and welded and a bead can be appropriately formed, a bottom end 215 of the range of the first contact portion 213 may be located below a back end 225 (bottom end in FIG. 1) of the range of the second contact portion 223 of the electrode lug 220 having the front-back length L2, and a portion of the first contact portion 213 around the bottom end 215 may protrude downward from the bottom end 225.

The electrode lugs 210 and 220 are arranged so that the left electrode lug 220, which includes the second contact portion 223 having the long front-back length L2, is fixed to the electrode lug device 200, and the right electrode lug 210, which includes the first contact portion 213 having the short front-back length L1, is slidable so as to clamp or release the bar 20 in the electrode lug device 200. The bar 20 clamped by the electrode lugs 210 and 220 is positioned in the front-back direction (vertical direction) by bringing a front end 27 (top end in FIGS. 1 and 2) of the bar 20 in the clamped state into contact with a positioning stopper (downwardly facing surface) 240.

In this example, the electrode lug device 200 having the above-described clamping structure is used. The bar 20 is placed between the first and second contact portions 213 and 223 of the right and left electrode lugs 210 and 220 having different front-back lengths, and the electrode lugs 210 and 220 are closed while the bar 20 is positioned in the front-back direction (vertical direction in the drawings). Thus, the bar 20 is clamped at the side surfaces 22 and 23 thereof by the second contact portion (end surface) 223 of the left electrode lug 220, which has the long front-back length L2, and the first contact portion (end surface) 213 of the right electrode lug 210, which has the short front-back length L1 and opposes a portion of the second contact portion 223 near the back end 225. Thus, the bar 20 is clamped by and fixed to the resistance welding electrode lugs 210 and 220 such that the second contact portion 223 of the left electrode lug 220 that is long in the front-back direction is in contact with a large portion of the bar 20 excluding the front and back end portions and having the front-back length L2, and such that the first contact portion 213 of the right electrode lug 210 having the short front-back length L1 is in contact with a portion of the bar 20 near the back end surface 25. Here, the bar 20 is clamped such that the range of the first contact portion 213 of the right electrode lug 210 in FIG. 1 having the short front-back length L1 is within the range of the second contact portion 223 of the left electrode lug 220 in FIG. 1 having the long front-back length L2. Therefore, the bar 20 is stably held in the clamping direction.

Figures 4A, 4B, 4C:
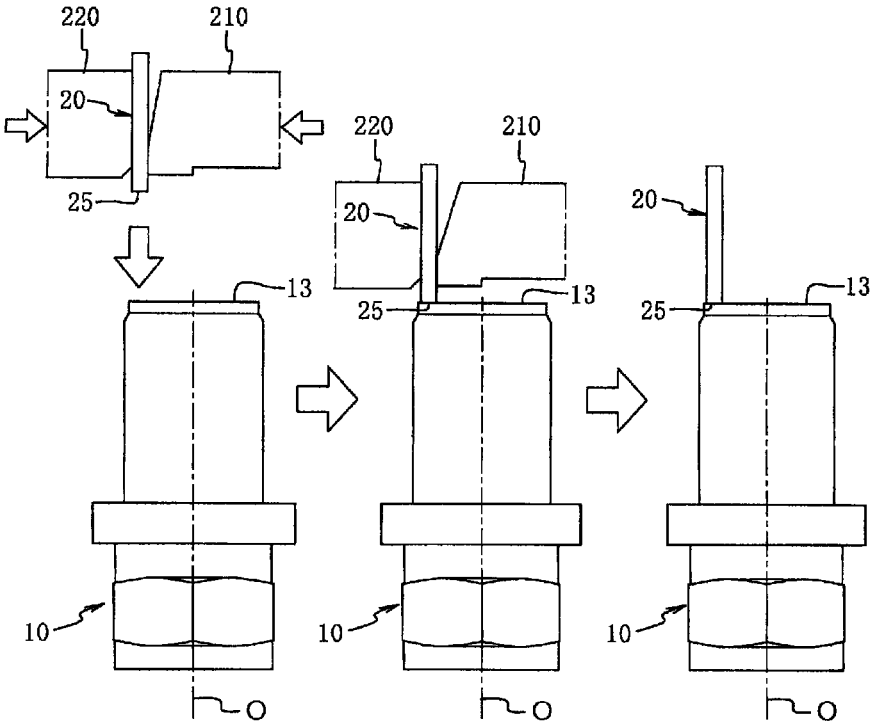
FIGS. 4A and 4B are schematic diagrams illustrating the process in which the bar illustrated in FIG. 1 is brought into contact with and welded to the front end surface of the metal shell.
FIG. 4C is a schematic diagram illustrating the state in which the electrode lugs are removed after the welding process.
Figure 5:
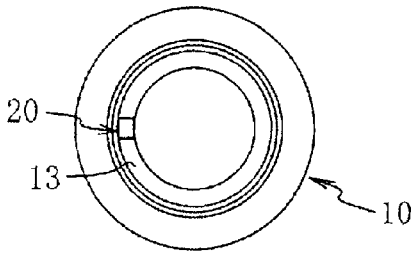
FIG. 5 is a plan view of FIG. 4C.

As illustrated in FIGS. 4A and 4B, for example, the electrode lug device 200 including the electrode lugs 210 and 220, which clamp the bar 20 and serve as one resistance welding electrode, is moved to bring the back end surface 25 of the clamped bar 20 against the front end surface 13 of the tubular metal shell 10 at an appropriate contact pressure (pressing force). The tubular metal shell 10 is positioned and secured by being clamped, for example, by the other resistance welding electrode. In this state, an electric current is passed between the resistance welding electrodes so that the back end surface 25 and the front end surface 13 are welded together by resistance butt welding.

In the resistance welding process, the resistance welding electrode connected to the bar 20 includes the pair of electrode lugs, as described above. One of the electrode lugs includes the first contact portion 213 that contacts the bar 20 and whose front-back length L1 is shorter than that in the structure of the related art. More specifically, the front-back length L1 of the first contact portion 213 of the right electrode lug 210 is shorter than that at the left. Therefore, unlike the clamping structure according to the related art in which the contact portions of the electrode lugs are both long in the front-back direction, the front-back length of the first contact portion 213 of the right electrode lug 210 is about ⅓ the front-back length at the left. Accordingly, the contact area between the bar 20 and the resistance welding electrode is greatly reduced. As a result, when an electric current is passed between the electrodes (resistance welding is performed) and heat is generated between the abutting surfaces of the metal shell 10 and the bar 20 due to resistance heating, dissipation of the generated heat to the right electrode lug 210 that clamps the bar 20 can be reduced. The heat concentration and heating efficiency at the abutting surfaces are higher than those in the structure of the related art in which the bar is clamped between the electrode lugs which each include a contact portion having a long front-back length. Accordingly, the welding efficiency, welding performance such as welding strength, and reliability are increased.

After the welding process, as illustrated in FIG. 4C, the electrode lugs are opened, for example, to remove the tubular metal shell 10 including the ground electrode bar from the resistance welding machine 100. After that, necessary processes, such as a process of forming the thread 16 and a plating process, are performed, and then the tubular metal shell 10 is transferred to a spark plug assembly process. As described above, the insulator and other components are assembled together, and then the bar 20 is bent to form the spark discharge gap. Thus, the spark plug is manufactured.

In this example, the bar 20 is clamped by the left and right electrode lugs 210 and 220, and the front-back length L1 of the first contact portion 213 of the right electrode lug 210 is about ⅓ the front-back length L2 of the second contact portion 223 of the left electrode lug 220. From the viewpoint of suppressing heat conduction (heat dissipation) to the electrode lugs, the front-back length L1 is preferably set so to be as short as possible to reduce to reduce the contact area (heat conduction area).

In this example, in addition to forming the first contact portion 213 of the right electrode lug 210 so that it has the short front-back length L1, the first contact portion 213 is arranged so as to oppose the second contact portion 223 of the left electrode lug 220 having the front-back length L2 over the entire length thereof in the front-back direction. Therefore, the bar 20 is prevented from being clamped in an unstable manner. The contact area between the bar 20 and the electrode lugs is reduced by reducing the length of the contact portion of only one of the electrode lugs instead of reducing the lengths of the contact portions of both of the electrode lugs. Therefore, when the bar 20 is clamped, one side surface 23 of the bar 20 comes into contact with the second contact portion 223 having the long front-back length L2, and the opposite side surface 22 of the bar 20 is pressed by the first contact portion 213 having the short front-back length against the second contact portion 223 within the range of the second contact portion 223 having the front-back length L2. Therefore, the bar 20 is prevented from tilting in the clamping direction (direction perpendicular to the clamping surfaces) and being held in an unstable orientation. As a result, a tubular metal shell 10 including a ground electrode bar for a spark plug in which heat dissipation can be reduced without reducing the dimensional precision can be provided.

In addition, in the above-described example, the first contact portion 213 of the right electrode lug 210 opposes a portion of the second contact portion 223 of the left electrode lug 220 at or near the back end 225. Therefore, in the resistance welding process, the current flows between the right electrode lug 210 and the bar 20 at a location close to the back end surface (abutting surface) 25, which is a welding surface, of the bar 20. Therefore, heat is effectively and efficiently generated at the abutting surfaces. Moreover, in this example, the first contact portion 213 of the right electrode lug 210 having a short front-back length has a flat surface, and is not sharp. Therefore, when the bar 20 is clamped, the contact surface of the bar 20 that is pressed against the first contact portion 213 does not receive an excessive local clamping pressure (force per unit area), and the generated heat can be dissipated along the flat contact surface. Accordingly, the contact surface is prevented from being dented or damaged due to the pressure in the local region thereof, and generation of large stress in the local region can be prevented. In addition, the thermal influence of heat concentration in the welding process on the local region can be reduced. As a result, partial embrittlement around the local region and reduction in strength due to the embrittlement do not occur, and the bar 20 can be smoothly bent to form the spark discharge gap in the subsequent step. To enhance these effects, the front-back length of the first contact portion 213 is preferably as long as possible within a range in which the front-back length is less than that of the second contact portion 223. However, in such a case, heat dissipation increases. The appropriate front-back length may be determined through welding tests based on which of the above-mentioned factors is important. The contact portion may have a curved surface or a spherical surface having a large radius instead of the flat surface.

Figure 6A:
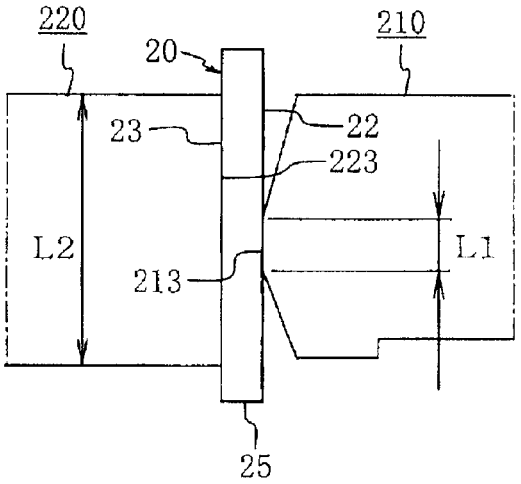
FIGS. 6A and 6B illustrate other examples of the shapes of a first contact portion and a second contact portion of the pair of electrode lugs.
Figure 6B:
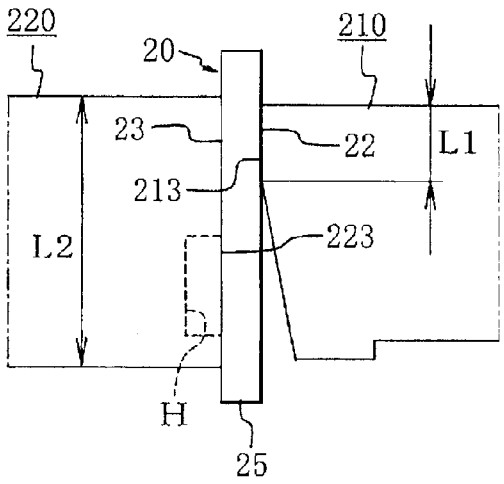

In the above-described example, the first contact portion 213 having a short front-back length is located so as to oppose a portion of the second contact portion 223 having a long front-back length near the back end surface 225 in the front-back direction. However, in the case where only the reduction in heat dissipation is important, as illustrated in FIG. 6A, the first contact portion 213 may be arranged so as to oppose a central portion of the second contact portion 223 in the front-back direction. Alternatively, as illustrated in FIG. 6B, the first contact portion 213 may be arranged so as to oppose a front portion of the second contact portion 223. However, to achieve heat concentration at the back end surface 25 of the bar 20, as described above, the first contact portion 213 is preferably arranged so as to oppose a portion of the second contact portion 223 that is as close to the back end surface 25 of the bar 20 as possible within a range in which the welding process is not adversely affected.

Figure 7:
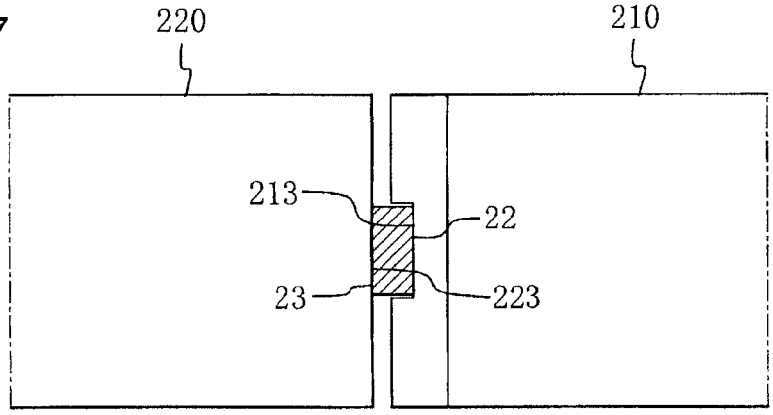
FIG. 7 is a sectional view (sectional view corresponding to FIG. 3) illustrating the case in which a recessed groove is formed in one of the pair of electrode lugs (first contact portion)
Figure 8:
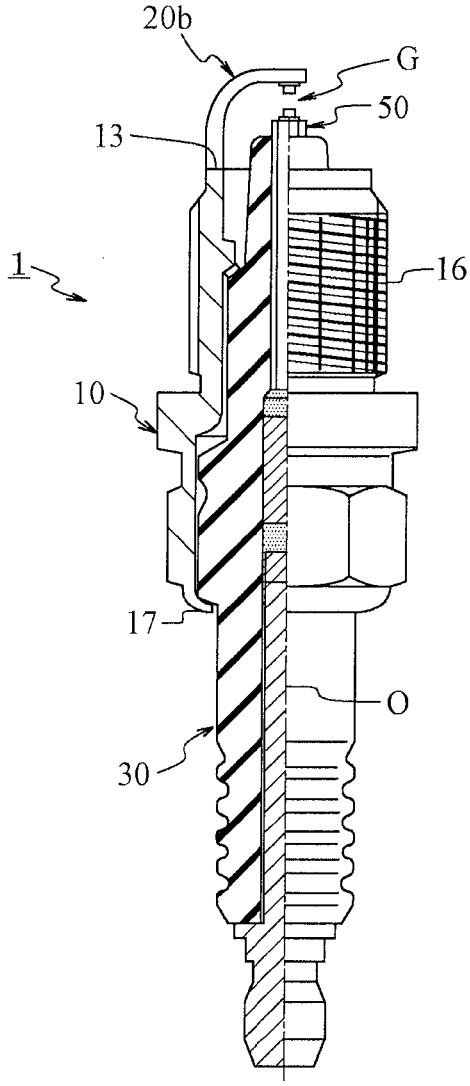
FIG. 8 is a longitudinal half-sectional view of a spark plug according to the related art.

In addition, in the above-described example, the first and second contact portions 213 and 223 of the electrode lugs 210 and 220 each have a flat surface. However, as illustrated in FIG. 7, the first contact portion 213, for example, may have a recessed groove capable of receiving a side surface of the bar 20. When such a recessed groove is formed, the clamped bar 20 can be prevented from moving or being displaced horizontally (in a horizontal direction along the clamping surfaces) or being tilted. As a result, the bar 20 can be clamped in a stable position and orientation. It is not necessary for the side walls of the recessed groove to extend continuously in the front-back direction. More specifically, projections that partially restrict the movement of the bar 20 in the horizontal direction may be provided. The recessed groove may be formed in each of the first and second contact portions of the pair of electrode lugs.

In the above-described example, the second contact portion 223 of the left electrode lug 220 having the long front-back length L2 includes a single (continuous) flat surface that extends in the front-back length. However, the second contact portion 223 may include, for example, a recess as shown by the dashed lines H in FIG. 6B in a region in which no clamping force is applied when the bar 20 is clamped between the second contact portion 223 and the first contact portion 213 of the right electrode lug 210 and which excludes regions near the front and back ends. In this case, the second contact portion 223 is partially spaced from the side surface 23 of the bar 20. Also in this case, the bar 20 can be reliably clamped in the clamping direction by the second contact portion 223 having a long front-back length and the first contact portion 213 having a short front-back length.

The present invention is not limited to the above-described embodiment, and modifications can be made as appropriate without departing from the scope of the present invention. For example, with regard to the opening-closing structure (chuck mechanism) for the electrode lugs and the shapes of the first and second contact portions, any structures and shapes may be employed as appropriate. In addition, in the above-described example, the bar is clamped in the thickness direction in cross section so that the electrode lug including the first contact portion having a short front-back length comes into contact with the side surface of the bar that faces the central axis of the metal shell, and the electrode lug including the second contact portion having a long front-back length comes into contact with the side surface of the bar that faces away from the central axis (outward). However, it is obvious that the arrangement of the electrode lugs may be reversed, and the bar may instead be clamped in the width direction in cross section. The present invention can, of course, be applied irrespective of the materials of the metal shell and the bar.

What is claimed is:

1. A method for manufacturing a tubular metal shell of a spark plug including a bar used for a ground electrode member of the spark plug, the method comprising the steps of:

bringing a front end surface of the tubular metal shell and a back end surface of the bar into contact with each other; and resistance-welding the tubular metal shell and the bar together by passing an electric current between resistance welding electrodes that are electrically connected to the tubular metal shell and the bar, wherein one of the resistance welding electrodes is a pair of electrode lugs that are electrically connected to the bar and have a clamping structure in which the bar is clamped at side surfaces of the bar to be electrically connected, wherein one of the electrode lugs includes a first contact portion that comes into contact with the bar and the other of the electrode lugs includes a second contact portion that comes into contact with the bar, the first contact portion having a front-back length shorter than a front-back length of the second contact portion, and coming into contact with the bar over a contact area smaller than a contact area over which the second contact portion comes into contact with the bar, and wherein, when the bar is clamped between the electrode lugs, the second contact portion is in surface-to-surface contact with the corresponding side surface of the bar.

2. The method according to claim 1, wherein the bar is clamped between the first contact portion and a portion of the second contact portion at or near a back end of the second contact portion.

3. The method according to claim 1, wherein the first contact portion includes a flat surface.

4. The method according to claim 1, wherein at least one of the first contact portion or the second contact portion has a recessed groove capable of receiving the bar.

5. A method for manufacturing a spark plug, comprising the step of:

manufacturing the tubular metal shell by the method according to claim 1.

* * * * *